US005775142A

United States Patent [19]

Kim

[11] Patent Number: 5,775,142

[45] Date of Patent: Jul. 7, 1998

[54] ELECTRONIC DOOR LOCK

[76] Inventor: Jitae Kim, 7266 Foanklin Ave. #303, Los Angeles, Calif. 90046

[21] Appl. No.: 759,985

[22] Filed: Dec. 3, 1996

[51] Int. Cl.[6] ..... E05B 49/00

[52] U.S. Cl. ..... 70/278; 70/279; 292/DIG. 65

[58] Field of Search ..... 70/276–283, 465, 70/DIG. 10; 340/825.31; 292/DIG. 66, DIG. 65

[56] References Cited

U.S. PATENT DOCUMENTS

| | | | |
|---|---|---|---|
| 4,148,092 | 4/1979 | Martin | 70/278 X |
| 4,534,194 | 8/1985 | Aydin | 70/278 |
| 4,677,834 | 7/1987 | Hicks | 70/279 |
| 4,755,799 | 7/1988 | Romano | 70/278 X |
| 4,901,545 | 2/1990 | Bacon et al. | 70/278 |
| 4,956,984 | 9/1990 | Chi-Cheng | 70/279 X |
| 4,979,383 | 12/1990 | Tully | 70/278 X |
| 5,027,629 | 7/1991 | Uu | 70/279 X |
| 5,083,122 | 1/1992 | Clark | 70/278 X |
| 5,113,675 | 5/1992 | Uyeda | 70/279 X |
| 5,136,870 | 8/1992 | Gartner et al. | 70/278 X |
| 5,184,491 | 2/1993 | Schittenhelm | 70/278 |
| 5,337,588 | 8/1994 | Chhatwal | 70/278 |
| 5,339,662 | 8/1994 | Goldman | 70/278 |
| 5,400,722 | 3/1995 | Moses et al. | 70/278 X |
| 5,475,996 | 12/1995 | Chen | 70/278 X |
| 5,495,733 | 3/1996 | Yen et al. | 70/279 |
| 5,527,074 | 6/1996 | Yeh | 792/DIG. 66 X |
| 5,529,973 | 6/1996 | Andreou et al. | 70/278 X |
| 5,570,914 | 11/1996 | Hughes | 292/DIG. 65 X |
| 5,592,838 | 1/1997 | Clark et al. | 70/278 X |
| 5,609,051 | 3/1997 | Donaldson | 70/279 X |

*Primary Examiner*—Suzanne Dino Barrett
*Attorney, Agent, or Firm*—Erik M. Arnhem

[57] ABSTRACT

A door lock includes an electronic keypad and magnetic card reader arranged to send coded signals to a central processing unit that controls a solenoid latch located proximate to the locking bolt. When the solenoid is energized by a signal from the central processing unit (or an auxiliary switch) the locking bolt can be operated from the locked position to the unlocked position; otherwise the solenoid latch prevents the bolt from being operated.

5 Claims, 2 Drawing Sheets

ELECTRONIC DOOR LOCK

BACKGROUND AND SUMMARY OF THE INVENTION

This invention relates to a door lock, and particularly to an electronic door lock controlled by an electronic keypad and coded identifier card.

Conventional door locks use keys for opening the lock or controlling the lock handle. In some cases the lock is controlled by a coded access card inserted into a slot in the lock housing.

The present invention relates to a door lock that is controlled by a coded access card and a numerical keypad on an external surface of the lock housing. In order to open the lock the person is required to insert an appropriate access card into a slot in the housing, and to also punch in the corresponding code on the keypad.

The invention prevents the lock from being opened by a person who has stolen a coded access card from the rightful holder. Should the thief insert the stolen card in the card access slot, without also punching the corresponding code into the keypad, the lock will remain in the locked condition.

Specific features of the invention will be apparent from the attached drawings and description of an illustrative embodiment of the invention.

THE DRAWINGS

DESCRIPTION OF A PREFERRED EMBODIMENT OF THE INVENTION

Figure 1:
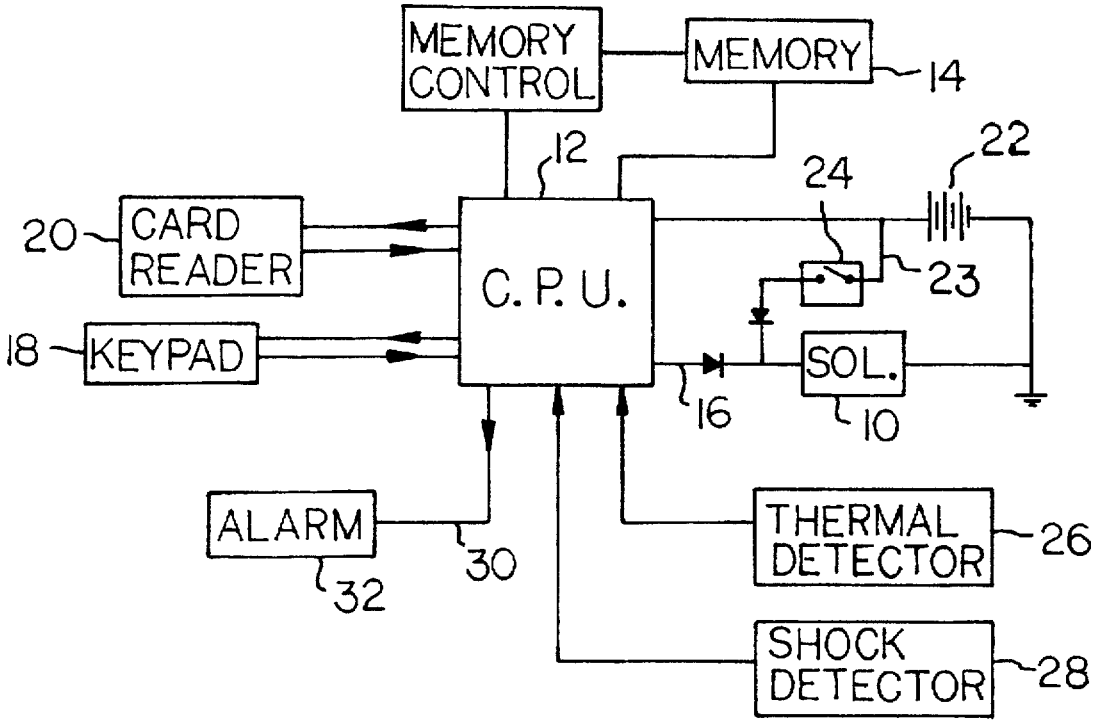
FIG. 1 is a block diagram of an electronic circuit for a door lock constructed according to the invention.
Figure 2:
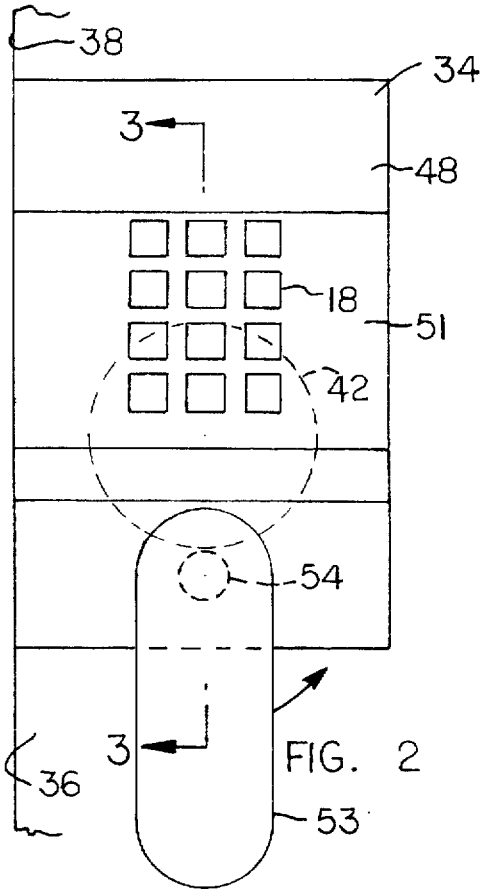
FIG. 2 is a front view of a door lock embodying the invention.
Figure 3:
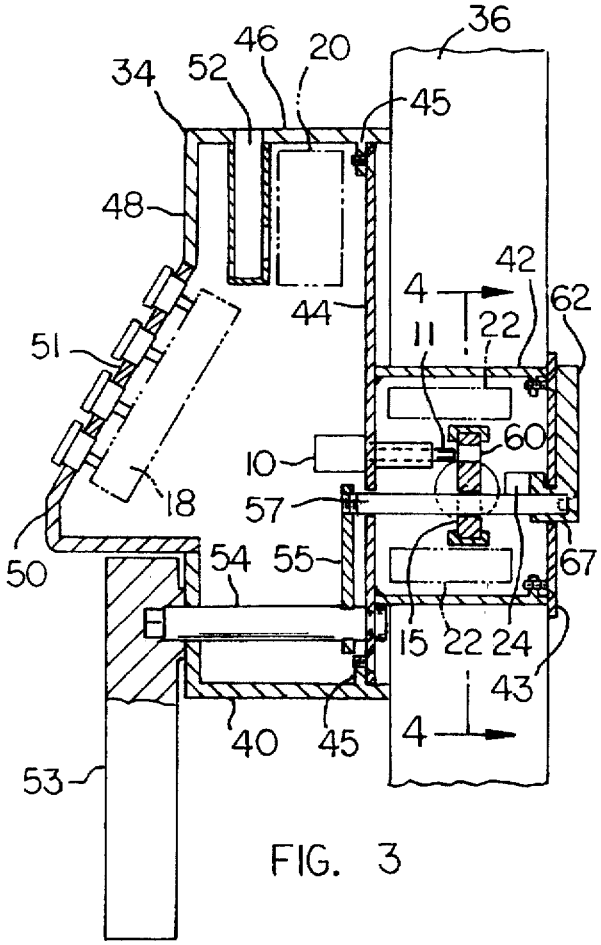
FIG. 3 is a sectional view taken substantially along line 3—3 in FIGS. 2 and 4.
Figure 5:
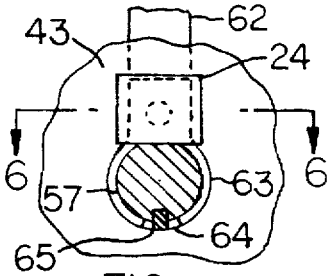
FIG. 5 is a fragmentary sectional view of a structural detail used in the FIG. 3 lock.

Referring to FIG. 1, there is shown an electronic control system for a door lock embodying the invention. The system comprises a solenoid 10 adapted to control manual actuation of a door locking bolt. FIGS. 2 through 6 show some features of a door lock that includes such a solenoid operatively connected to a locking bolt 15. When solenoid 10 is in a de-energized condition it is impossible to manually operate the door lock; when solenoid 10 is energized the door lock can be operated to the locked or unlocked condition.

The control system of FIG. 1 comprises a central processing unit 12 having a memory 14 containing a number of access codes for controlling a signal delivered from the central processing unit 12 through line 16 to solenoid 10. The control system further comprises a keypad 18 and card reader 20 electrically connected to the central processing unit. A dry cell battery pack 22 delivers power to the central processing unit.

When a coded access card having the same code as one of the memorized codes in memory 14 is inserted into the card reader the memory generates a first energizing signal in the central processing unit. When the keypad 18 is operated to generate the same access code as the inserted card the memory generates a second energizing signal in the central processing unit. The simultaneous presence of both energizing signals triggers the central processing unit to deliver an energizing signal through line 16 to the solenoid. Unless both the card reader and the keypad produce identical signal patterns the solenoid will remain in a de-energized condition.

Keypad 18 and card reader 20 are located on one side of the door, e.g. the external side of the door. In order to operate the locking bolt from the other side of the door, e.g. the room side of the door, a second energizing line 23 is provided for solenoid 10. A switch 24 is provided in line 23 to control current flow (on or off). The system enables the door to be opened from either side, e.g. the external side or the internal (room) side.

In preferred practice of the invention the door lock housing is equipped with a thermal detector 26 mounted on an interior surface of the housing. The detector can be one or more thermistors conductively secured to the housing interior surface for delivering an alarm signal to the central processing unit when the housing is heated to an elevated temperature by a torch (or laser) that might be used in an attempt to defeat the lock.

The control system can further include a shock detector 28 mounted on an interior surface of the lock housing for sending an alarm signal to the central processing unit 12, responsive to a destructive hammer attack on the lock housing. Shock detector 28 can be a strain gage or inertia switch mounted on an interior surface of the lock housing.

The central processing unit 12 includes an output 30 for energizing an alarm 32 responsive to the generation of a trigger signal by thermal detector 26 or shock detector 28. Alarm 32 can be a siren, whistle or other sound generator built into the lock housing. Alternately, alarm 32 can be a telephone hook-up designed to deliver a telephone signal to a remote security monitoring facility.

FIGS. 2 through 6 show a door lock designed to utilize the electronic control system of FIG. 1. As shown, the door lock comprises a housing 34 mounted on door 36 proximate to the door edge 38. Housing 34 comprises an external housing section 40 and an internal housing section 42 located within the door. Housing section 42 comprises a cylindrical tube secured within the door by a face plate 43. An internal connection plate 44 is welded or otherwise attached to tube 42 for releasably connecting the tube to external housing section 40.

The external housing section 40 has a series of internal lugs 45 adapted to seat against the face of connector plate 44, whereby the plate can be screwed to the lugs to connect housing sections 40 and 42 together. The lug-screw connections enable housing section 40 to be separated from plate 44 for accessing the electrical components located in housing section 40.

Housing 34 comprises an external top wall 46 and an external front wall 48 facing away from the associated door 36. Front wall 48 includes a forwardly protruding section 50 that forms a rearwardly inclined wall section 51. The aforementioned keypad 18 is mounted on the inclined wall section, whereby the upwardly facing keys are easily viewed by a person facing the keyboard. The individual keys have identifying numbers or letters thereon that enable the person to punch in a code peculiar to that person. Each person authorized to enter the facility controlled by door 36 is provided with a particular access code, i.e. a particular sequence of numbers corresponding to particular numbered keys on keypad 18. Additionally, each authorized person is supplied with a coded access card having the same magnetized access code.

Top 46 of the external housing has an access slot 52 adapted to receive coded access cards that are then readable by the card reader 20. As previously noted, when the card reader and keypad 18 send identical memorized access codes to the central processing unit, a signal is delivered through line 16 (FIG. 1) to solenoid 10, thereby enabling the person to operate the locking bolt 15.

The manual mechanism for operating the locking bolt comprises a handle 53 connected to a rotary shaft 54 in housing section 40. An arm 55 extends upwardly from shaft 54 so as to be swingable between the two positions depicted in FIG. 4. Arm 55 is attached to a rod 57 that extends through a slot 59 in locking bolt 15, whereby swinging movement of arm 55 moves the locking bolt between its retracted position and its extended position. Suitable guides are provided in tubular housing section 42 for ensuring a smooth sliding motion of the locking bolt.

Figure 4:
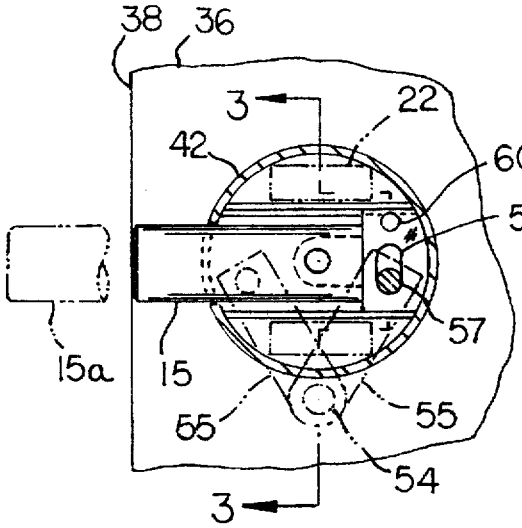
FIG. 4 is a fragmentary sectional view taken on line 4—4 in FIG. 3.
Figure 6:
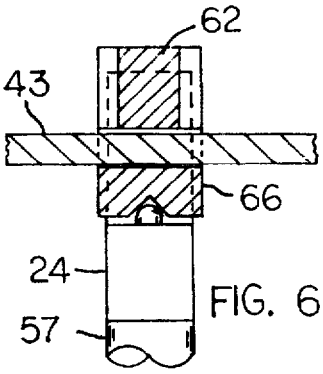
FIG. 6 is a fragmentary sectional view taken on line 6—6 in FIG. 5.

The aforementioned solenoid 10 is equipped with a latch plunger 11 that registers with a transverse hole 60 in the locking bolt when the bolt is in its extended position 15*a* (FIG. 4). In the de-energized condition of the solenoid, plunger 11 is extended from the solenoid for entry into hole 60. In the energized condition of the solenoid, plunger 11 is retracted into the solenoid (i.e. out of the plane of hole 60).

With the described arrangement, the locking bolt can be held against movement when solenoid 10 is de-energized and freed for movement when the solenoid is energized. Thus, assuming the locking bolt is in the locked position 15*a*, the de-energized solenoid prevents handle 53 from moving the locking bolt. However, when the keypad 18 and card reader 20 deliver the appropriate signals to central processing unit 12, the solenoid is energized to move plunger 11 out of the latch hole 60, thereby enabling handle 53 to move the latching bolt from the locking position to the unlocking position.

In order to operate the locking bolt from the other side of the door (e.g. the room side), there is provided a manual handle 62 having a swivel fit on rod 57. An arcuate slot 67 in face plate 43 enables handle 62 to swing rod 57 around the axis of shaft 54 for operating the locking bolt 15. Handle 62 includes a tubular section 63 encircling rod 57 and having a clearance slot 64 for a stop 65 on the rod, whereby the handle can swing to a limited extent around the rod axis.

A micro-switch 24 is mounted on rod 57, such that the switch plunger is located within a V-shaped cam recess in a wall portion 66 of the handle. With this arrangement, the handle can swivel on rod 57 to actuate switch 24 at the beginning of the handle motion. Switch 24 energizes solenoid 10, so that handle 62 can be moved freely back and forth to operate the locking bolt from the room side of the door.

In preferred practice of the invention the dry cell batteries 22 are preferably located in tubular housing section 42, in order to facilitate the battery-changing process. The central processing unit 12, keypad 18, and card reader 20 are located in external housing section 40. Housing section 40 is preferably formed of a strong tough material resistant to attack, e.g. hardened steel or composite materials. The aforementioned thermal detectors 26 and shock detector 28 are mounted on the interior surface of housing section 40. Alarm 32 can also be located in housing section 40.

The drawings necessarily show a specific form of the invention. However, it will be appreciated that the invention can take various forms and configurations.

What is claimed is:

1. A lock for a door, wherein said door has a first side and a second side, said lock comprising:

a housing having an external section locatable on the first side of the door, and an internal section locatable within the door;

a reciprocable locking bolt in said internal section of said housing;

a handle mounted on said external section of the housing for operating said locking bolt from the first side of the door;

a central processing unit located within said external section of the housing; said central unit having a number of memorized access codes;

a battery power source for said central processing unit, said power source being located within said internal section of the housing;

a card reader in said external section of the housing for sending access codes to the central processing unit;

a keypad on said external section of the housing for sending access codes to the central processing unit; and electrically-operated latch means connected to said central processing unit for normally retaining said locking bolt against movement; said central processing unit being operable to electrically disengage said latch means from said locking bolt when said central processing unit receives identical memorized access codes from the card reader and keypad.

2. The door lock of claim 1, wherein said internal section of the housing comprises a cylindrical tube.

3. The door lock of claim 2, wherein said housing comprises an internal connector plate secured to said cylindrical tube; said external section of the housing being detachably connected to said connector plate.

4. The door lock of claim 2, wherein said latch means comprises a solenoid mounted on said internal connector plate.

5. The door lock of claim 1, and further comprising a second handle for operating said locking bolt from the second side of the door; and electrical switch means controlled by said second handle for electrically disengaging said latch means from said locking bolt.

* * * * *